US010591120B2

(12) United States Patent
Bailey et al.

(10) Patent No.: US 10,591,120 B2
(45) Date of Patent: Mar. 17, 2020

(54) LIGHTING MODULE FOR RECESSED LIGHTING SYSTEMS

(71) Applicant: DMF, Inc., Carson, CA (US)

(72) Inventors: Michael D. Bailey, Long Beach, CA (US); Michael D. Danesh, Beverly Hills, CA (US)

(73) Assignee: DMF, Inc., Carson, CA (US)

( * ) Notice: Subject to any disclaimer, the term of this patent is extended or adjusted under 35 U.S.C. 154(b) by 4 days.

(21) Appl. No.: 15/167,682

(22) Filed: May 27, 2016

(65) Prior Publication Data

US 2016/0348861 A1 Dec. 1, 2016

Related U.S. Application Data

(60) Provisional application No. 62/168,510, filed on May 29, 2015.

(51) Int. Cl.
*F21S 8/02* (2006.01)
*F21V 23/00* (2015.01)
(Continued)

(52) U.S. Cl.
CPC ..... *F21S 8/026* (2013.01); *F21S 8/024* (2013.01); *F21V 23/002* (2013.01);
(Continued)

(58) Field of Classification Search
CPC ... F21S 8/026; F21S 8/024; F21S 8/02; F21V 23/002; F21V 23/006; F21V 29/507;
(Continued)

(56) References Cited

U.S. PATENT DOCUMENTS 1,471,340 A 10/1923 Knight
2,038,784 A 4/1936 Ghadiali
(Continued)

FOREIGN PATENT DOCUMENTS

CA 2243934 C 6/2002
CA 2502637 A1 9/2005
(Continued)

OTHER PUBLICATIONS

DMF, Inc., "dmfLighting: LED Recessed Lighting Solutions", *Info sheets*, (Mar. 19, 2012), 4 pages.
(Continued)

*Primary Examiner* — Bao Q Truong
(74) *Attorney, Agent, or Firm* — Smith Baluch LLP

(57) ABSTRACT

A housing has a sidewall that surrounds an interior cavity that has an open rear end and an open front end, and is divided by a partition into a top cavity and a bottom cavity. The top cavity extends to the open rear end, the bottom cavity extends to the open front end. A power supply circuit board is inside the top cavity, while a light source is inside the bottom cavity and emits light through the open front end to illuminate a room. First wires pass through an opening in the partition, and are coupled to the power supply circuit board at one end and to the light source at another end, to deliver power to the light source. A lid or cover covers the open rear end enclosing the top cavity, and is secured to the housing. Other embodiments are also described and claimed.

24 Claims, 5 Drawing Sheets

(51) Int. Cl.

| | |
|---|---|
| *F21V 7/22* | (2018.01) |
| *F21V 5/04* | (2006.01) |
| *F21V 23/02* | (2006.01) |
| *F21V 29/77* | (2015.01) |
| *F21V 29/507* | (2015.01) |
| *F21V 29/89* | (2015.01) |
| *F21K 9/20* | (2016.01) |
| *F21Y 115/10* | (2016.01) |

(52) U.S. Cl.
CPC ..... *F21V 23/006* (2013.01); *F21K 9/20* (2016.08); *F21V 5/04* (2013.01); *F21V 7/22* (2013.01); *F21V 23/02* (2013.01); *F21V 29/507* (2015.01); *F21V 29/77* (2015.01); *F21V 29/89* (2015.01); *F21Y 2115/10* (2016.08)

(58) Field of Classification Search
CPC . F21V 29/77; F21V 29/89; F21V 5/04; F21V 7/22; F21V 21/02; F21V 21/04; F21V 15/01; F21V 15/013; F21V 7/00; F21V 7/0091; F21V 7/24; F21V 7/28; F21K 9/20; F21Y 2115/10
See application file for complete search history.

(56) References Cited

U.S. PATENT DOCUMENTS 2,197,737 A 4/1940 Appleton
2,528,989 A 11/1950 Ammells
2,642,246 A 6/1953 Larry
D180,844 S 8/1957 Poliakoff
3,023,920 A 3/1962 Cook et al.
3,422,261 A 1/1969 McGinty
3,460,299 A 8/1969 Wilson
3,650,046 A 3/1972 Skinner
3,711,053 A 1/1973 Drake
D227,989 S 7/1973 Geisel
3,812,342 A 5/1974 Mcnamara
D245,905 S 9/1977 Taylor
4,088,827 A 5/1978 Kohaut
4,176,758 A 12/1979 Glick
4,399,497 A 8/1983 Druffel
4,520,435 A 5/1985 Baldwin
4,601,145 A 7/1986 Wilcox
4,723,747 A 2/1988 Karp et al.
4,729,080 A 3/1988 Fremont et al.
4,754,377 A * 6/1988 Wenman ..... F21S 8/02 362/148
4,930,054 A 5/1990 Krebs
5,216,203 A 6/1993 Gower
5,239,132 A 8/1993 Bartow
5,250,269 A 10/1993 Langer et al.
5,266,050 A 11/1993 O'Neil et al.
5,382,752 A 1/1995 Reyhan et al.
5,465,199 A 11/1995 Bray et al.
5,505,419 A 4/1996 Gabrius
5,544,870 A 8/1996 Kelley et al.
5,562,343 A 10/1996 Chan et al.
5,571,993 A 11/1996 Jones et al.
5,580,158 A 12/1996 Aubrey et al.
5,588,737 A 12/1996 Kusmer
5,603,424 A 2/1997 Bordwell et al.
5,613,338 A 3/1997 Esposito
D381,111 S 7/1997 Lecluze
5,662,413 A 9/1997 Akiyama
D386,277 S 11/1997 Lecluze
D387,466 S 12/1997 Lecluze
5,738,436 A 4/1998 Cummings et al.
5,836,678 A 11/1998 Wright et al.
5,942,726 A 8/1999 Reiker
5,944,412 A 9/1999 Janos et al.
6,082,878 A 7/2000 Doubek et al.
6,105,334 A 8/2000 Monson et al.
6,161,910 A 12/2000 Reisenauer et al.
6,170,685 B1 1/2001 Currier
6,174,076 B1 1/2001 Petrakis et al.
6,176,599 B1 1/2001 Farzen
6,267,491 B1 7/2001 Parrigin
6,332,597 B1 12/2001 Korcz et al.
6,350,043 B1 2/2002 Gloisten
6,364,511 B1 4/2002 Cohen
6,402,112 B1 6/2002 Thomas et al.
D461,455 S 8/2002 Forbes
6,461,016 B1 10/2002 Jamison et al.
6,474,846 B1 11/2002 Kelmelis et al.
6,491,413 B1 12/2002 Benesohn
D468,697 S 1/2003 Straub, Jr.
6,515,313 B1 2/2003 Ibbetson et al.
6,583,573 B2 6/2003 Bierman
6,585,389 B2 7/2003 Bonazzi
6,600,175 B1 7/2003 Baretz et al.
D478,872 S 8/2003 Heggem
6,657,236 B1 12/2003 Thibeault et al.
6,666,419 B1 12/2003 Vrame
D488,583 S 4/2004 Benghozi
6,719,438 B2 4/2004 Sevack et al.
6,758,578 B1 7/2004 Chou
6,777,615 B1 8/2004 Gretz
6,827,229 B2 12/2004 Dinh et al.
6,906,352 B2 6/2005 Edmond et al.
D509,314 S 9/2005 Rashidi
6,948,829 B2 9/2005 Verdes et al.
6,958,497 B2 10/2005 Emerson et al.
6,964,501 B2 11/2005 Ryan
D516,235 S 2/2006 Rashidi
7,064,269 B2 6/2006 Smith
D528,673 S 9/2006 Maxik et al.
D531,740 S 11/2006 Maxik
D532,532 S 11/2006 Maxik
7,148,420 B1 12/2006 Johnson et al.
7,154,040 B1 12/2006 Tompkins
7,170,015 B1 1/2007 Roesch et al.
D536,349 S 2/2007 Humber et al.
D537,039 S 2/2007 Pincek
D539,229 S 3/2007 Murphey
7,186,008 B2 3/2007 Patti
7,190,126 B1 3/2007 Paton
7,211,833 B2 5/2007 Slater, Jr. et al.
7,213,940 B1 5/2007 Van De Ven et al.
D547,889 S 7/2007 Huang
D552,969 S 10/2007 Bobrowski et al.
D553,267 S 10/2007 Yuen
D555,106 S 11/2007 Pape et al.
D556,144 S 11/2007 Dinh
7,297,870 B1 11/2007 Sartini
7,312,474 B2 12/2007 Emerson et al.
7,320,536 B2 1/2008 Petrakis et al.
D561,372 S 2/2008 Yan
D561,373 S 2/2008 Yan
7,335,920 B2 2/2008 Denbaars et al.
D563,896 S 3/2008 Greenslate
7,347,580 B2 3/2008 Blackman et al.
D570,012 S 5/2008 Huang
7,374,308 B2 5/2008 Sevack et al.
D570,504 S 6/2008 Maxik et al.
D570,505 S 6/2008 Maxik et al.
7,399,104 B2 7/2008 Rappaport
D578,677 S 10/2008 Huang
7,431,482 B1 10/2008 Morgan et al.
7,432,440 B2 10/2008 Hull et al.
7,442,883 B2 10/2008 Jolly et al.
7,446,345 B2 11/2008 Emerson et al.
7,473,005 B2 1/2009 O'Brien
7,488,097 B2 2/2009 Reisenauer et al.
7,503,145 B2 3/2009 Newbold et al.
7,524,089 B2 4/2009 Park
D591,894 S 5/2009 Flank
7,534,989 B2 5/2009 Suehara et al.
D596,154 S 7/2009 Rivkin
7,566,154 B2 7/2009 Gloisten et al.
D599,040 S 8/2009 Alexander et al.
D600,836 S 9/2009 Hanley et al.

(56) References Cited

U.S. PATENT DOCUMENTS

| | | | |
|---|---|---|---|
| 7,588,359 | B2 | 9/2009 | Coushaine et al. |
| 7,592,583 | B2 | 9/2009 | Page et al. |
| D606,696 | S | 12/2009 | Chen et al. |
| 7,625,105 | B1 | 12/2009 | Johnson |
| 7,628,513 | B2 | 12/2009 | Chiu |
| 7,651,238 | B2 | 1/2010 | O'Brien |
| 7,654,705 | B2 | 2/2010 | Czech et al. |
| D611,650 | S | 3/2010 | Broekhoff |
| 7,670,021 | B2 | 3/2010 | Chou |
| 7,673,841 | B2 | 3/2010 | Wronski |
| 7,677,766 | B2 | 3/2010 | Boyer |
| 7,692,182 | B2 | 4/2010 | Bergmann et al. |
| 7,704,763 | B2 | 4/2010 | Fujii et al. |
| D616,118 | S | 5/2010 | Thomas et al. |
| 7,722,208 | B1 | 5/2010 | Dupre et al. |
| 7,722,227 | B2 | 5/2010 | Zhang et al. |
| 7,735,795 | B2 | 6/2010 | Wronski |
| 7,735,798 | B2 | 6/2010 | Kojima |
| 7,748,887 | B2 | 7/2010 | Zampini, II et al. |
| 7,766,518 | B2 | 8/2010 | Piepgras et al. |
| 7,769,192 | B2 | 8/2010 | Takagi et al. |
| 7,771,082 | B2 | 8/2010 | Peng |
| 7,771,094 | B2 | 8/2010 | Goode |
| D624,692 | S | 9/2010 | Mackin et al. |
| D625,847 | S | 10/2010 | Maglica |
| D625,876 | S | 10/2010 | Chen et al. |
| D627,727 | S | 11/2010 | Alexander et al. |
| D629,366 | S | 12/2010 | Ericson et al. |
| 7,871,184 | B2 | 1/2011 | Peng |
| 7,874,539 | B2 | 1/2011 | Wright et al. |
| 7,874,709 | B1 | 1/2011 | Beadle |
| D633,224 | S | 2/2011 | Lee |
| D636,903 | S | 4/2011 | Torenbeek |
| D637,339 | S | 5/2011 | Hasan et al. |
| D637,340 | S | 5/2011 | Hasan et al. |
| 7,950,832 | B2 | 5/2011 | Tanaka et al. |
| D639,499 | S | 6/2011 | Choi et al. |
| D640,819 | S | 6/2011 | Pan |
| 7,959,332 | B2 | 6/2011 | Tickner et al. |
| 7,967,480 | B2 | 6/2011 | Pickard et al. |
| D642,317 | S | 7/2011 | Rashidi |
| 7,972,035 | B2 | 7/2011 | Boyer |
| 7,972,043 | B2 | 7/2011 | Schutte |
| D642,536 | S | 8/2011 | Robinson |
| D643,970 | S | 8/2011 | Kim et al. |
| D646,011 | S | 9/2011 | Rashidi |
| 8,013,243 | B2 | 9/2011 | Korcz et al. |
| 8,038,113 | B2 | 10/2011 | Fryzek et al. |
| D648,476 | S | 11/2011 | Choi et al. |
| D648,477 | S | 11/2011 | Kim et al. |
| D650,115 | S | 12/2011 | Kim et al. |
| 8,070,328 | B1 | 12/2011 | Knoble et al. |
| 8,096,670 | B2 | 1/2012 | Trott et al. |
| D654,205 | S | 2/2012 | Rashidi |
| D656,263 | S | 3/2012 | Ogawa et al. |
| 8,142,057 | B2 | 3/2012 | Roos et al. |
| 8,152,334 | B2 | 4/2012 | Krogman |
| D658,788 | S | 5/2012 | Dudik et al. |
| D658,802 | S | 5/2012 | Chen |
| D659,862 | S | 5/2012 | Tsai |
| D659,879 | S | 5/2012 | Rashidi |
| D660,814 | S | 5/2012 | Wilson |
| 8,182,116 | B2 | 5/2012 | Zhang et al. |
| 8,201,968 | B2 | 6/2012 | Maxik et al. |
| D663,058 | S | 7/2012 | Pan |
| D663,466 | S | 7/2012 | Rashidi |
| D664,274 | S | 7/2012 | de Visser et al. |
| D664,705 | S | 7/2012 | Kong et al. |
| 8,215,805 | B2 | 7/2012 | Cogliano et al. |
| 8,220,970 | B1 | 7/2012 | Khazi |
| 8,226,270 | B2 | 7/2012 | Yamamoto et al. |
| 8,240,630 | B2 | 8/2012 | Wronski |
| D667,155 | S | 9/2012 | Rashidi |
| 8,262,255 | B1 | 9/2012 | Rashidi |
| D668,372 | S | 10/2012 | Renshaw et al. |
| D668,809 | S | 10/2012 | Rashidi |
| D669,198 | S | 10/2012 | Qui |
| D669,199 | S | 10/2012 | Chuang |
| D669,620 | S | 10/2012 | Rashidi |
| 8,277,090 | B2 | 10/2012 | Fryzek et al. |
| 8,308,322 | B2 | 11/2012 | Santiago et al. |
| D673,869 | S | 1/2013 | Yu |
| D676,263 | S | 2/2013 | Birke |
| D676,814 | S | 2/2013 | Paul |
| 8,376,593 | B2 | 2/2013 | Bazydola et al. |
| D677,417 | S | 3/2013 | Rashidi |
| D677,634 | S | 3/2013 | Korcz et al. |
| D679,047 | S | 3/2013 | Tickner et al. |
| 8,403,533 | B1 | 3/2013 | Paulsel |
| 8,403,541 | B1 | 3/2013 | Rashidi |
| D681,259 | S | 4/2013 | Kong |
| 8,408,759 | B1 | 4/2013 | Rashidi |
| D682,459 | S | 5/2013 | Gordin et al. |
| D683,063 | S | 5/2013 | Lopez et al. |
| D683,890 | S | 6/2013 | Lopez et al. |
| D684,269 | S | 6/2013 | Wang et al. |
| D684,719 | S | 6/2013 | Rashidi |
| D685,118 | S | 6/2013 | Rashidi |
| D685,120 | S | 6/2013 | Rashidi |
| 8,454,204 | B1 | 6/2013 | Chang et al. |
| D685,507 | S | 7/2013 | Sun |
| D687,586 | S | 8/2013 | Rashidi |
| D687,587 | S | 8/2013 | Rashidi |
| D687,588 | S | 8/2013 | Rashidi |
| D687,980 | S | 8/2013 | Gravely et al. |
| D688,405 | S | 8/2013 | Kim et al. |
| D690,049 | S | 9/2013 | Rashidi |
| D690,864 | S | 10/2013 | Rashidi |
| D690,865 | S | 10/2013 | Rashidi |
| D690,866 | S | 10/2013 | Rashidi |
| D691,314 | S | 10/2013 | Rashidi |
| D691,315 | S | 10/2013 | Samson |
| D691,763 | S | 10/2013 | Hand et al. |
| 8,550,669 | B2 | 10/2013 | Macwan et al. |
| D693,043 | S | 11/2013 | Schmalfuss et al. |
| D693,517 | S | 11/2013 | Davis |
| D694,456 | S | 11/2013 | Rowlette, Jr. et al. |
| 8,573,816 | B2 | 11/2013 | Negley et al. |
| D695,441 | S | 12/2013 | Lui et al. |
| D696,446 | S | 12/2013 | Huh |
| D696,447 | S | 12/2013 | Huh |
| D696,448 | S | 12/2013 | Huh |
| 8,602,601 | B2 | 12/2013 | Khazi et al. |
| D698,067 | S | 1/2014 | Rashidi |
| D698,068 | S | 1/2014 | Rashidi |
| 8,622,361 | B2 | 1/2014 | Wronski |
| D698,985 | S | 2/2014 | Lopez et al. |
| D699,384 | S | 2/2014 | Rashidi |
| D699,687 | S | 2/2014 | Baldwin et al. |
| D700,387 | S | 2/2014 | Snell |
| 8,641,243 | B1 | 2/2014 | Rashidi |
| 8,659,034 | B2 | 2/2014 | Baretz et al. |
| D701,175 | S | 3/2014 | Baldwin et al. |
| D701,466 | S | 3/2014 | Clifford et al. |
| D702,867 | S | 4/2014 | Kim et al. |
| D703,843 | S | 4/2014 | Cheng |
| 8,684,569 | B2 | 4/2014 | Pickard et al. |
| D705,472 | S | 5/2014 | Huh |
| 8,727,582 | B2 | 5/2014 | Brown et al. |
| D708,381 | S | 7/2014 | Rashidi |
| 8,777,449 | B2 | 7/2014 | Ven et al. |
| D710,529 | S | 8/2014 | Lopez et al. |
| 8,801,217 | B2 | 8/2014 | Oehle et al. |
| 8,820,985 | B1 | 9/2014 | Tam et al. |
| 8,833,013 | B2 | 9/2014 | Harman |
| D714,989 | S | 10/2014 | Rowlette, Jr. et al. |
| 8,870,426 | B2 | 10/2014 | Biebl et al. |
| 8,890,414 | B2 | 11/2014 | Rowlette, Jr. et al. |
| D721,845 | S | 1/2015 | Lui et al. |
| 8,939,418 | B2 | 1/2015 | Green et al. |
| D722,296 | S | 2/2015 | Taylor |
| D722,977 | S | 2/2015 | Hagarty |
| D722,978 | S | 2/2015 | Hagarty |
| 8,950,898 | B2 | 2/2015 | Catalano |

(56) References Cited

U.S. PATENT DOCUMENTS

D726,363 S 4/2015 Danesh
D726,949 S 4/2015 Redfern
9,004,435 B2 4/2015 Wronski
9,039,254 B2 5/2015 Danesh
D731,689 S 6/2015 Bernard et al.
9,062,866 B1 6/2015 Christ et al.
9,065,264 B2 6/2015 Cooper et al.
9,068,719 B2 6/2015 Van De Ven et al.
D734,525 S 7/2015 Gordin et al.
D735,012 S 7/2015 Cowie
D735,142 S 7/2015 Hagarty
9,078,299 B2 7/2015 Ashdown
D739,590 S 9/2015 Redfern
9,140,441 B2 9/2015 Goelz et al.
D742,325 S 10/2015 Leung
9,151,457 B2 10/2015 Pickard et al.
9,151,477 B2 10/2015 Pickard et al.
9,217,560 B2 12/2015 Harbers et al.
9,222,661 B2 12/2015 Kim et al.
9,239,131 B1 1/2016 Wronski et al.
9,285,103 B2 3/2016 Van De Ven et al.
9,291,319 B2 3/2016 Kathawate et al.
9,301,362 B2 3/2016 Dohn et al.
D754,078 S 4/2016 Baldwin et al.
D754,079 S 4/2016 Baldwin et al.
D754,605 S 4/2016 McMillan
9,303,812 B2 4/2016 Green et al.
9,310,038 B2 4/2016 Athalye
9,322,543 B2 4/2016 Hussell et al.
9,347,655 B2 5/2016 Boomgaarden et al.
9,366,418 B2 6/2016 Gifford
9,371,966 B2 6/2016 Rowlette, Jr. et al.
D762,181 S 7/2016 Lin
9,395,051 B2 7/2016 Hussell et al.
D762,906 S 8/2016 Jeswani et al.
D764,079 S 8/2016 Wu
9,417,506 B1 8/2016 Tirosh
D766,185 S 9/2016 Hagarty
D767,199 S 9/2016 Wronski et al.
9,447,917 B1 9/2016 Wronski et al.
D768,325 S 10/2016 Xu
D768,326 S 10/2016 Guzzini
D769,501 S 10/2016 Jeswani et al.
D770,065 S 10/2016 Tittle
9,476,552 B2 10/2016 Myers et al.
D776,324 S 1/2017 Gierl et al.
D777,967 S 1/2017 Redfern
9,534,751 B2 1/2017 Maglica et al.
D778,241 S 2/2017 Holbrook et al.
D778,484 S 2/2017 Guzzini
D779,100 S 2/2017 Redfern
9,581,302 B2 2/2017 Danesh
9,599,315 B1 3/2017 Harpenau et al.
9,605,910 B2 3/2017 Swedberg et al.
D785,228 S 4/2017 Guzzini
D786,472 S 5/2017 Redfern
D786,474 S 5/2017 Fujisawa
D788,330 S 5/2017 Johnson et al.
D790,102 S 6/2017 Guzzini
9,673,597 B2 6/2017 Lee
9,689,541 B2 6/2017 Wronski
D791,709 S 7/2017 Holton
D791,711 S 7/2017 Holton
D791,712 S 7/2017 Holton
9,696,021 B2 7/2017 Wronski
9,702,516 B1 7/2017 Vasquez et al.
D795,820 S 8/2017 Wengreen
9,732,904 B1 8/2017 Wronski
9,739,464 B2 8/2017 Wronski
9,791,111 B1 10/2017 Huang et al.
9,803,839 B2 10/2017 Visser et al.
D805,660 S 12/2017 Creasman et al.
D809,176 S 1/2018 Partington
9,863,619 B2 1/2018 Mak
D809,465 S 2/2018 Keirstead
9,964,266 B2 5/2018 Danesh
D820,494 S 6/2018 Cohen
9,995,441 B2 6/2018 Power et al.
29,653,142 6/2018 Danesh et al.
D824,494 S 7/2018 Martins et al.
29,664,471 9/2018 Danesh et al.
D832,218 S 10/2018 Wronski et al.
D833,977 S 11/2018 Danesh et al.
10,139,059 B2 11/2018 Danesh
D836,976 S 1/2019 Reese et al.
D848,375 S 5/2019 Danesh et al.
2002/0172047 A1 11/2002 Ashley
2003/0006353 A1 1/2003 Dinh et al.
2003/0021104 A1 1/2003 Tsao
2003/0161153 A1 8/2003 Patti
2004/0001337 A1 1/2004 Defouw et al.
2005/0225966 A1 10/2005 Hartmann et al.
2005/0227536 A1 10/2005 Gamache et al.
2005/0231962 A1 10/2005 Koba et al.
2005/0237746 A1 10/2005 Yiu
2006/0005988 A1 1/2006 Jorgensen
2006/0158873 A1 7/2006 Newbold et al.
2006/0198126 A1 9/2006 Jones
2006/0215408 A1 9/2006 Lee
2006/0237601 A1 10/2006 Rinderer
2006/0243877 A1 11/2006 Rippel
2006/0250788 A1 11/2006 Hodge et al.
2007/0035951 A1 2/2007 Tseng
2007/0185675 A1 8/2007 Papamichael et al.
2007/0200039 A1 8/2007 Petak
2007/0206374 A1 9/2007 Petrakis et al.
2008/0002414 A1 1/2008 Miletich et al.
2008/0112168 A1 5/2008 Pickard et al.
2008/0112170 A1 5/2008 Trott
2008/0112171 A1 5/2008 Patti et al.
2008/0137347 A1 6/2008 Trott et al.
2008/0165545 A1 7/2008 O'Brien
2008/0232116 A1 9/2008 Kim
2008/0247181 A1 10/2008 Dixon
2009/0003009 A1 1/2009 Tessnow et al.
2009/0034261 A1 2/2009 Grove
2009/0080189 A1 3/2009 Wegner
2009/0086484 A1 4/2009 Johnson
2009/0135613 A1 5/2009 Peng
2009/0141500 A1 6/2009 Peng
2009/0141506 A1 6/2009 Lan et al.
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2009/0283292 A1 11/2009 Lehr
2009/0290343 A1 11/2009 Brown et al.
2010/0014282 A1 1/2010 Danesh
2010/0061108 A1 3/2010 Zhang et al.
2010/0110690 A1 5/2010 Hsu et al.
2010/0110698 A1 5/2010 Harwood et al.
2010/0148673 A1 6/2010 Stewart et al.
2010/0149822 A1 6/2010 Cogliano et al.
2010/0165643 A1 7/2010 Russo et al.
2010/0244709 A1 9/2010 Steiner et al.
2010/0246172 A1 9/2010 Liu
2010/0259919 A1* 10/2010 Khazi ..... F21S 8/026
362/84
2010/0270903 A1 10/2010 Jao et al.
2010/0284185 A1 11/2010 Ngai
2010/0302778 A1 12/2010 Dabiet et al.
2011/0043040 A1 2/2011 Porter et al.
2011/0063831 A1 3/2011 Cook
2011/0068687 A1 3/2011 Takahasi et al.
2011/0069499 A1 3/2011 Trott et al.
2011/0080750 A1 4/2011 Jones et al.
2011/0116276 A1 5/2011 Okamura et al.
2011/0134634 A1 6/2011 Gingrich, III et al.
2011/0134651 A1 6/2011 Berman
2011/0140633 A1 6/2011 Archenhold
2011/0170294 A1 7/2011 Mier-Langner et al.
2011/0194299 A1 8/2011 Crooks et al.
2011/0216534 A1 9/2011 Tickner et al.

(56) References Cited

U.S. PATENT DOCUMENTS

| | | | |
|---|---|---|---|
| 2011/0226919 | A1 | 9/2011 | Fryzek et al. |
| 2011/0241557 | A1 | 10/2011 | Grotkowski et al. |
| 2011/0255292 | A1 | 10/2011 | Shen |
| 2011/0267828 | A1 | 11/2011 | Bazydola et al. |
| 2011/0285314 | A1 | 11/2011 | Carney et al. |
| 2012/0020104 | A1 | 1/2012 | Biebl et al. |
| 2012/0074852 | A1 | 3/2012 | Delnoij |
| 2012/0106176 | A1 | 5/2012 | Lopez et al. |
| 2012/0113642 | A1 | 5/2012 | Catalano |
| 2012/0140442 | A1 | 6/2012 | Woo et al. |
| 2012/0140490 | A1* | 6/2012 | Rowlette, Jr. ..... F21K 9/00 362/373 |
| 2012/0162994 | A1 | 6/2012 | Wasniewski et al. |
| 2012/0182744 | A1 | 7/2012 | Santiago et al. |
| 2012/0188762 | A1 | 7/2012 | Joung et al. |
| 2012/0243237 | A1 | 9/2012 | Toda et al. |
| 2012/0287625 | A1 | 11/2012 | Macwan et al. |
| 2012/0305868 | A1 | 12/2012 | Callahan et al. |
| 2013/0009552 | A1 | 1/2013 | Page |
| 2013/0010476 | A1 | 1/2013 | Pickard et al. |
| 2013/0016864 | A1 | 1/2013 | Ivey et al. |
| 2013/0033872 | A1 | 2/2013 | Randolph et al. |
| 2013/0051012 | A1 | 2/2013 | Oehle et al. |
| 2013/0141913 | A1 | 6/2013 | Sachsenweger |
| 2013/0163254 | A1 | 6/2013 | Chang et al. |
| 2013/0170232 | A1 | 7/2013 | Park et al. |
| 2013/0170233 | A1 | 7/2013 | Nezu et al. |
| 2013/0258677 | A1 | 10/2013 | Fryzek et al. |
| 2013/0265750 | A1 | 10/2013 | Pickard et al. |
| 2013/0271989 | A1 | 10/2013 | Hussell et al. |
| 2013/0294084 | A1 | 11/2013 | Kathawate et al. |
| 2013/0301252 | A1 | 11/2013 | Hussell et al. |
| 2013/0322062 | A1 | 12/2013 | Danesh |
| 2013/0322084 | A1 | 12/2013 | Ebisawa |
| 2013/0335980 | A1 | 12/2013 | Nakasuji et al. |
| 2014/0036497 | A1 | 2/2014 | Hussell et al. |
| 2014/0049957 | A1 | 2/2014 | Goelz et al. |
| 2014/0063776 | A1 | 3/2014 | Clark et al. |
| 2014/0063818 | A1* | 3/2014 | Randolph ..... F21V 7/0091 362/311.02 |
| 2014/0071679 | A1 | 3/2014 | Booth |
| 2014/0071687 | A1 | 3/2014 | Tickner et al. |
| 2014/0140490 | A1 | 5/2014 | Roberts et al. |
| 2014/0159616 | A1 | 6/2014 | Wang et al. |
| 2014/0233246 | A1 | 8/2014 | Lafreniere et al. |
| 2014/0254177 | A1 | 9/2014 | Danesh |
| 2014/0265933 | A1 | 9/2014 | Melanson et al. |
| 2014/0268836 | A1 | 9/2014 | Thompson |
| 2014/0299730 | A1 | 10/2014 | Green et al. |
| 2014/0321122 | A1 | 10/2014 | Domagala et al. |
| 2014/0347848 | A1 | 11/2014 | Pisavadia et al. |
| 2015/0009676 | A1 | 1/2015 | Danesh |
| 2015/0029732 | A1 | 1/2015 | Hatch |
| 2015/0138779 | A1 | 5/2015 | Livesay et al. |
| 2015/0184837 | A1 | 7/2015 | Zhang et al. |
| 2015/0198324 | A1 | 7/2015 | O'Brien et al. |
| 2015/0219317 | A1 | 8/2015 | Gatof et al. |
| 2015/0233556 | A1 | 8/2015 | Danesh |
| 2015/0241039 | A1 | 8/2015 | Fryzek |
| 2015/0263497 | A1 | 9/2015 | Korcz et al. |
| 2015/0276185 | A1 | 10/2015 | Bailey et al. |
| 2015/0308662 | A1 | 10/2015 | Vice et al. |
| 2015/0345761 | A1 | 12/2015 | Lawlor |
| 2015/0362159 | A1 | 12/2015 | Ludyjan |
| 2016/0126860 | A1 | 5/2016 | Summerland |
| 2016/0209007 | A1 | 7/2016 | Belmonte et al. |
| 2016/0218626 | A1 | 7/2016 | Del Carmen |
| 2016/0308342 | A1 | 10/2016 | Witherbee et al. |
| 2016/0312987 | A1 | 10/2016 | Danesh |
| 2016/0348860 | A1 | 12/2016 | Danesh |
| 2016/0366738 | A1 | 12/2016 | Boulanger et al. |
| 2017/0045213 | A1 | 2/2017 | Williams et al. |
| 2017/0059135 | A1 | 3/2017 | Jones |
| 2017/0138576 | A1 | 5/2017 | Peng et al. |
| 2017/0138581 | A1 | 5/2017 | Doust |
| 2017/0307188 | A1 | 10/2017 | Oudina et al. |

FOREIGN PATENT DOCUMENTS

| | | | |
|---|---|---|---|
| CA | 2691480 | C | 4/2012 |
| CA | 2734369 | A1 | 10/2013 |
| CA | 2561459 | A1 | 11/2013 |
| CA | 2815067 | | 11/2013 |
| CA | 2848289 | A1 | 10/2014 |
| CN | 2182475 | Y | 11/1994 |
| CN | 201059503 | Y | 5/2008 |
| CN | 201259125 | Y | 6/2009 |
| CN | 101608781 | | 12/2009 |
| CN | 201636626 | U | 11/2010 |
| CN | 102062373 | A | 5/2011 |
| CN | 202014067 | U | 10/2011 |
| CN | 202392473 | U | 11/2011 |
| CN | 103307518 | A | 3/2012 |
| CN | 202733693 | U | 2/2013 |
| CN | 103322476 | A | 9/2013 |
| CN | 203215483 | U | 9/2013 |
| CN | 101498411 | B | 11/2013 |
| CN | 104654142 | A | 11/2013 |
| CN | 203273663 | U | 11/2013 |
| CN | 203297980 | U | 11/2013 |
| CN | 103712135 | B | 12/2013 |
| CN | 203628464 | U | 12/2013 |
| CN | 203641919 | U | 6/2014 |
| CN | 204300818 | U | 4/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 205606362 | U | 9/2016 |
| CN | 2016130742 | U | 4/2017 |
| CN | 103154606 | B | 5/2017 |
| CN | 206222112 | U | 6/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1672155 | A1 | 6/2006 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2427020 | A | 12/2006 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 6/2013 |
| JP | 2015002028 | A2 | 1/2015 |
| JP | 20171076699 | A2 | 6/2017 |
| KR | 1020110008796 | A | 1/2011 |
| KR | 1020120061625 | A | 6/2012 |
| MX | 2011002947 | A | 9/2011 |
| TW | 474382 | U | 1/2002 |
| WO | WO 2013/128896 | A1 | 9/2013 |
| WO | WO 2015/000212 | A1 | 1/2015 |
| WO | WO 2016152166 | A2 | 8/2016 |

OTHER PUBLICATIONS

Halo, *Halo LED H4 H7 Collection, SustainabLEDesign, Cooper Lighting*, (emphasis on p. 18 "H7 Collection LED Modules—Halo LED H7 Module Features"), (Mar. 28, 2012), 52 pages.

Halo, *H7 LED Downlight Trims 49x Series, 6-inch LED Trims for Use with ML7x LED Modules, Cooper Lighting*, ADV110422, (rev. Aug. 12, 2011), 15 pages.

HALO, *LED Module ML706x, Cooper Lighting*, General Installation for All Modules/p. 1; Tether Installation/pp. 2-3; Installation

(56) References Cited

OTHER PUBLICATIONS into HALO H750x Series LED—only (Non-Screw based) Recessed Fixture/p. 4, (Oct. 20, 2009), 4 pages.
Non-Final Office Action (dated Oct. 16, 2014), U.S. Appl. No. 13/484,901, filed May 31, 2012, First Named Inventor: Michael D. Danesh, 15 pages.
Final Office Action (dated Apr. 2, 2015), U.S. Appl. No. 13/484,901, filed May 31, 2012, First Named Inventor: Michael D. Danesh, 13 pages.
Non-Final Office Action (dated Jul. 20, 2015), U.S. Appl. No. 14/184,601, filed Feb. 19, 2014, First Named Inventor: Michael D. Danesh, 19 pages.
Non-Final Office Action (dated Sep. 15, 2015) U.S. Appl. No. 13/484,901, filed May 31, 2012. First Named Inventor: Michael D. Danesh, 16.
Final Office Action (dated Apr. 27, 2016), U.S. Appl. No. 14/184,601, filed Feb. 19, 2014, First Named Inventor: Michael D. Danesh, 18.
Final Office Action (dated Jun. 23, 2016), U.S. Appl. No. 13/484,901, filed May 31, 2012 First Named Inventor: Michael D. Danesh, 18 pages.
"*DME Series Installation Instructions*", (Oct. 18, 2011).
Canadian Office Action dated Dec. 23, 2013 from Canadian Application No. 2,778,581, 3 pages.
Canadian Office Action dated Mar. 22, 2016 from Canadian Application No. 2,879,629, 4 pages.
Canadian Office Action dated Feb. 1, 2016 from Canadian Application No. 2,879,486, 5 pages.
Canadian Office Action dated Jun. 12, 2017 from Canadian Application No. 2,927,601, 4 pages.
Canadian Office Action dated Aug. 11, 2017 from Canadian Application No. 2,941,051, 4 pages.
Final Office Action dated Jul. 26, 2017 from U.S. Appl. No. 14/184,601, 18 pages.
Final Office Action dated Jan. 29, 2016 from U.S. Appl. No. 14/183,424, 21 pages.
Non-Final Office Action dated May 17, 2017 from U.S. Appl. No. 14/183,424, 20 pages.
Non-Final Office Action dated Jun. 2, 2015 from U.S. Appl. No. 14/183,424, 20 pages.
Notice of Allowance dated Aug. 23, 2017 from Canadian Application No. 2,879,629, 1 page.
Notice of Allowance dated Oct. 21, 2016 from U.S. Appl. No. 13/484,901, 7 pages.
Canadian Office Action, dated Mar. 9, 2017, Canadian Application No. 2,931,588.
Non-Final Office Action, dated Dec. 15, 2016, U.S. Appl. No. 14/184,601.
Canadian Office Action, dated Dec. 6, 2016, Canadian Application No. 2,879,629.
Acrich COB Zhaga Module, Product Description, Seoul Semiconductor, Nov. 2016, 39 pages.
<https://www.zhagastandard.org/books/book18/>, Mar. 2017, 5 pages.
Non-Final Office Action dated May 16, 2018 for U.S. Appl. No. 15/132,875, 18 pages.
Notice of Allowance dated May 10, 2018 from U.S. Appl. No. 14/726,064, 7 pages.
2006 International Building Code, Section 712 Penetrations, 2006, 4 pages.
BXUV.GuideInfo, Fire Resistance Ratings—ANSI/UL 263, UL Online Certifications Directory, last updated Nov. 3, 2016, 27 pages.
CEYY.GuideInfo, Outlet Boxes and Fittings Certified for Fire Resistance, UL Online Certifications Directory, last updated May 16, 2013, 2 pages.
DMF, Inc., "dmfLIGHTING: LED Recessed Downlighting," DRD2 Product Brochure, Oct. 23, 2014, 50 pages.
DMF, Inc., "dmfLIGHTING: LED Recessed Downlighting," Product Catalog, Aug. 2012, 68 pages.
"Membrane Penetrations in Fire-Resistance Rated Walls," https://www.ulcom/wp-content/uploads/2014/04/ul_MembranePenetrations.pdf, Issue 1, 2009, 2 pages.
"Metallic Outlet Boxes," UL 514A, Underwriters Laboratories, Inc., Feb. 16, 2004 (Title Page Reprinted Aug. 10, 2007), 106 pages.
"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
Notice of Allowance dated Mar. 26, 2018 for U.S. Appl. No. 14/184,601, 10 pages.
Non-Final Office Action dated Mar. 15, 2010 from U.S. Appl. No. 12/100,148, 8 pages.
Non-Final Office Action dated Apr. 30, 2010 from U.S. Appl. No. 12/173,232, 13 pages.
Non-Final Office Action dated Sep. 5, 2014 from U.S. Appl. No. 13/791,087, 8 pages.
Non-Final Office Action dated Sep. 6, 2017 from U.S. Appl. No. 14/726,064, 8 pages.
Non-Final Office Action dated Apr. 12, 2018 for U.S. Appl. No. 29/638,259, 5 pages.
Notice of Allowance dated Jan. 30, 2015 from U.S. Appl. No. 13/791,087, 9 pages.
Notice of Allowance dated Jan. 16, 2015 from U.S. Appl. No. 29/467,026, 9 pages.
Notice of Allowance dated Mar. 24, 2016 from U.S. Appl. No. 14/247,149, 8 pages.
"Outlet Boxes for Use in Fire Rated Assemblies," https://www.ul.com/wp-content/uploads/2014/04/Ul_outletboxes.pdf, 2011, 2 pages.
Cree LED Lamp Family Sales Sheet - Better light is beautiful light , Apr. 24, 2017, 2 pages.
"Advanced LED Solutions," lmtra Marine Lighting. 2011. 39 pages.
"Portland Bi-Color, Warm White/Red," item:ILIM30941.Imtra Marine Products. 2012. 3 pages
"Cree LMH2 LED Modules," Mouser Electronics. 2 pages.
"Cree LMH2 LED Module with TrueWhite Technology," Cree Product Family Data Sheet. 2011. 3 pages.
"Cree LMH2 LED Modules Design Guide," Cree Product Design Guide. 2011. 20 pages.
"Undercabinet Pucks, Xyris Mini LED Puck Light," ELCO Lighting. Sep. 2018. 1 page.
"LED Undercabinet Pocket Guide," ELCO Lighting.12 pages.
"VERSI LED Mini Flush," Lithonia Lghting. 6 pages.
OneFrame Recessed LED Downlight. Dmflighting.com. Published Jun. 6, 2018. Retrieved at https://www.dmflighting.com/product/oneframe on Jun. 6, 2018. 11 pages.
Notice of Allowance dated May 22, 2018 from U.S. Appl. No. 14/183,424, 9 pages.
Non-Final Office Action dated Jun. 25, 2018 for U.S. Appl. No. 29/541,565, 10 pages.
Notice of Allowance dated Sep. 21, 2018 from U.S. Appl. No. 29/645,941, 5 pages.
Notice of Allowance dated Oct. 4, 2018 from U.S. Appl. No. 15/947,065, 9 pages.
Notice of Allowance dated Oct. 9, 2018 from U.S. Appl. No. 29/653,142, 7 pages.
Non-Final Office Action dated Oct. 24, 2018 for U.S. Appl. No. 15/688,266, 14 pages.
Civil Action No. 2:18-cv-07090. Complaint for Infringement and Unfair Competition. *DMF, Inc.* v. *AMP Plus, Inc. d/b/a Elco Lighting.* 52 pages, dated Aug. 15, 2018.
International Search Report and Written Opinion in International Patent Application No. PCT/US18/39048 dated Dec. 14, 2018 24 pages.
International Search Report and Written Opinion in PCT/US2018/048357 dated Nov. 14, 2018, 13 pages.
Non-Final Office Action dated Dec. 5, 2018 from U.S. Appl. No. 14/942,937, 13 pages.
Non-Final Office Action dated Feb. 7, 2019 from U.S. Appl. No. 16/200,393, 32 pages.
Non-Final Office Action dated Jul. 24, 2018 from U.S. Appl. No. 29/638,259, 5 pages.
Notice of Allowance dated Feb. 8, 2019 from U.S. Appl. No. 29/541,565, 5 pages.
Notice of Allowance dated Jan. 2, 2019 from U.S. Appl. No. 29/541,565, 6 pages.

(56) References Cited

OTHER PUBLICATIONS

Notice of Allowance dated Jan. 28, 2019 from U.S. Appl. No. 29/664,471, 8 pages.
RACO 4 in. Octagon Welded Concrete Ring, 3-1/2 in. Deep with 1/2 and 3/4 in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
RACO 4 in. Octagon Welded Concrete Ring, 6 in. Deep with 1/2 and 3/4 in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
4" Octagon Concrete Boxes and Back Plates. Appleton. Accessed at www.appletonelec.com on May 6, 2019. 1 page.
Cooper Lighting HALO ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
CS&E PCT Collaborative Search and Examination Pilot Upload Peer Contribution in International Patent Application No. PCT/US18/62868 dated Mar. 14, 2019, 61 pages.
CS&E PCT Collaborative Search and Examination Pilot Upload Peer Contribution in International Patent Application No. PCT/US18/67614 dated Apr. 24, 2019, 53 pages.
Ex-Parte Quayle Action dated Jun. 27, 2019 from U.S. Appl. No. 29/683,730, 5 pages.
Final Office Action dated Jun. 6, 2019 from U.S. Appl. No. 15/688,266, 7 pages.
Final Office Action dated Mar. 15, 2019 from U.S. Appl. No. 15/132,875,15 pages.
IC1JB Housing 4" IC-Rated New Construction Junction Box Housing. AcuityBrands. Accessed at https://www.acuitybrands.com/en/products/detail/845886/juno/ic1jb-housing/4-ic-rated-new-construction-junction-box-housing on Jun. 27, 2019.
Imtra Marine Lighting 2008 Catalog. 40 pages.
Imtra Marine Lighting 2009 Catalog. 32 pages.
Imtra Marine Lighting Spring 2007 Catalog. 36 pages.
International Search Report and Written Opinion in International Patent Application No. PCT/US18/62868 dated Mar. 14, 2019, 13 pages.
International Search Report and Written Opinion in International Patent Application No. PCT/US18/67614 dated Apr. 25, 2019, 20 pages.
Kwikbrace@ New Construction Braces for Lighting Fixtures or Ceiling Fans 1-1/2 in. Depth. Hubbel. Accessed at https://hubbellcdn.com/specsheet/926.pdf on Jun. 27, 2019. 1 page.
Non-Final Office Action dated Apr. 4, 2019 from U.S. Appl. No. 29/678,482, 8 pages.
Non-Final Office Action dated Jun. 11, 2019 from U.S. Appl. No. 15/901,738, 6 pages.
Notice of Allowance dated Apr. 17, 2019 from U.S. Appl. No. 29/678,478, 7 pages.
Notice of Allowance dated Apr. 8, 2019 from U.S. Appl. No. 29/653,142, 8 pages.
Notice of Allowance dated Jun. 12, 2019 from U.S. Appl. No. 16/016,040, 8 pages.
RACO Commercial, Industrial and Residential Electrical Products. Hubbell. Accessed at www.Hubbell-RTB.com on May 6, 2019. 356 pages.
Specification & Features 4" Octagonal Concrete Box Covers. Orbit Industries, Inc. Accessed at https://www.orbitelectric.com on May 6, 2019. 1 page.

* cited by examiner

LIGHTING MODULE FOR RECESSED LIGHTING SYSTEMS

This application claims the benefit of the earlier filing date of U.S. Provisional Patent Application No. 62/168,510, filed May 29, 2015.

An embodiment of the invention relates to a recessed lighting system with improved packaging of power supply circuitry, light source, and optics. Other embodiments are also described.

BACKGROUND

Recessed lighting fixtures are typically installed or mounted into an opening in a ceiling or a wall. Modern recessed lighting fixtures generally consist of a trim, an LED-based light source module, an electronic power supply or driver circuit, and a legacy incandescent "can" in which the light source module and driver circuit are housed. The can and a junction box are mounted to a frame or platform, which in turn is attached to the internal structural member that is behind the wall, via hangar bars.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments are described with reference to the appended drawings. While numerous details are set forth, it is understood that some embodiments of the invention may be practiced without these details. In other instances, well-known circuits, structures, and techniques have not been shown in detail so as not to obscure the understanding of this description.

Figure 4:
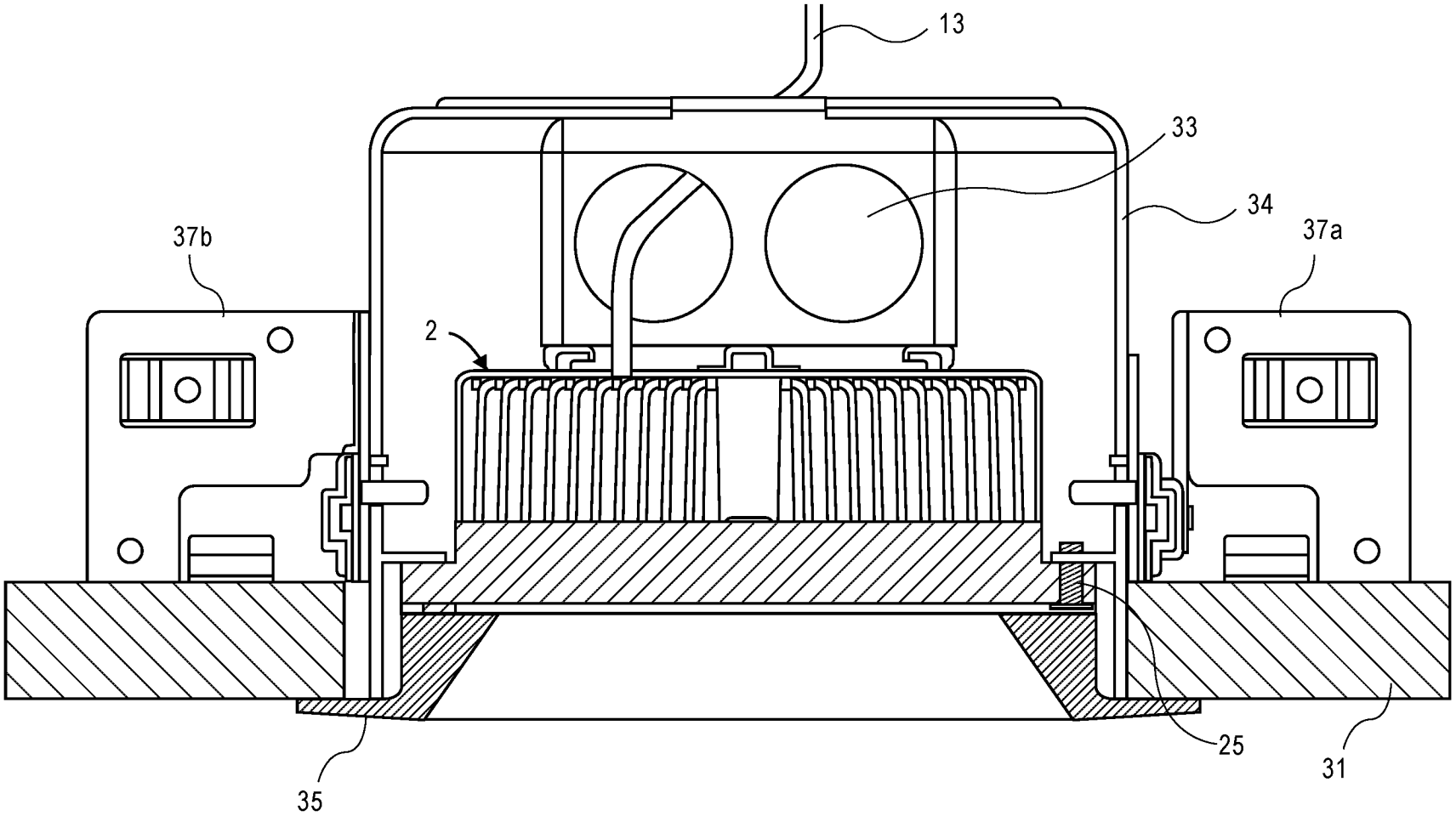
FIG. 4 shows the lighting module installed as part of an example recessed lighting system.

An embodiment of the recessed lighting system described here is shown in a section view in FIG. 4. The system serves to illuminate a room, and is located behind a ceiling or a wall 31 of the room. The system has a lighting module whose housing 2 has been installed, for this particular example only, within a junction box 34 that is secured to joists of the building, behind the wall 31, by a pair of hanger bars 37*a*, 37*b*. Electrical wires 13 that are behind the wall 31 serve to bring mains electricity power into the housing 2 of the lighting module, through the rear end of the housing 2. In this example, the wires 13 are routed through a knockout 33 of the junction box 34. The recessed lighting system in this example also includes a trim 35 that is affixed to front end of the housing 2 of the lighting module. The trim 35 covers the exposed edge of the ceiling or wall 31 where an opening is formed for light to emerge from the front end of the housing 2. Other applications of the lighting module include its installation within a legacy incandescent can or other enclosure, and the use of attachment mechanisms other than the hanger bars 37*a*, 37*b* to secure the system to other building structural members.

Figure 1:
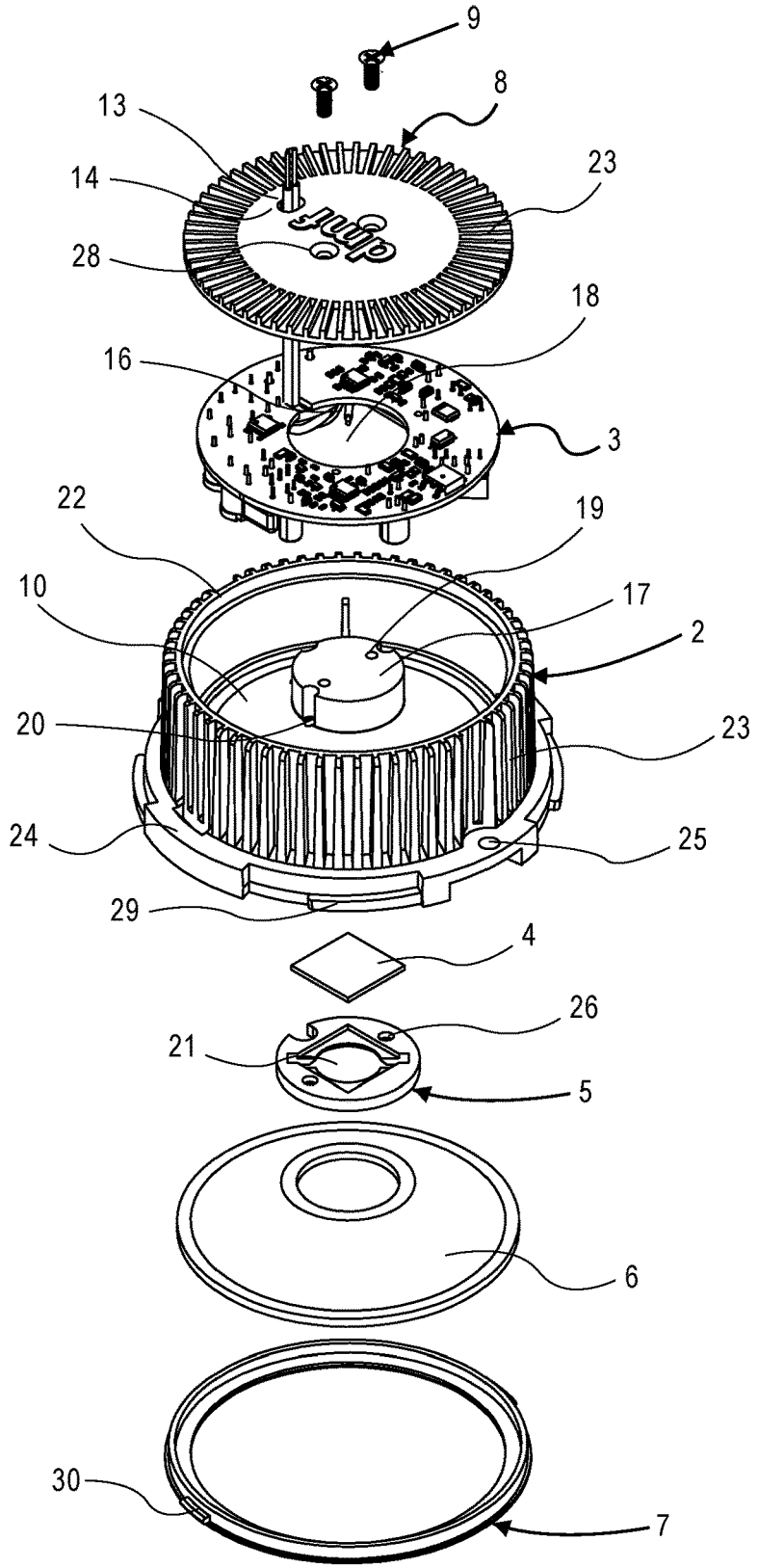
FIG. 1 shows an exploded view of a lighting module for recessed lighting systems, according to one embodiment of the invention.

FIG. 1 shows an exploded view of the lighting module, in accordance with an embodiment of the invention. Not shown are the trim and the mechanism by which the recessed lighting system can be installed behind a wall or ceiling—such aspects may be entirely conventional as discussed above in connection with the example of FIG. 4, e.g. through the use of a legacy incandescent can and platform with hangar bars, or other suitable attachment mechanism. In one embodiment, the lighting module has a housing 2, a power supply circuit board 3, a light source 4, a light source holder 5, an optic 6, a retaining ring 7, a cover 8, and one or more screws 9. Not all of these components however are necessary for every embodiment of the invention, as discussed below. The housing 2 may be composed of any thermally conductive material, e.g., aluminum alloys, copper, copper-tungsten pseudoalloy, AlSiC (silicon carbide in aluminum matrix), Dymalloy (diamond in copper-silver alloy matrix), E-Material (beryllium oxide in beryllium matrix), and/or thermally conductive plastics or ceramics. The housing 2 is generally cylindrical with an open rear end and an open front end that are defined at opposite ends of a sidewall 22 that forms a closed loop as shown (surrounding an interior cavity). Note however that while FIG. 1 shows the sidewall 22 as having a circular cross-section, other shapes are possible including elliptical and polygonal. The exterior or outside surface of the sidewall 22 may include features that improve a heat sink function, such as fins 23 that may entirely surround the housing 2 as shown. These fins 23 are passive components that serve to cool the housing 2 and any nearby heat producing or heat sensitive components such as the power supply circuit board 3, the light source 4 and the optic 6. The fins 23 may be integrally formed, e.g., manufactured by being cast into the housing 2.

Figure 2:
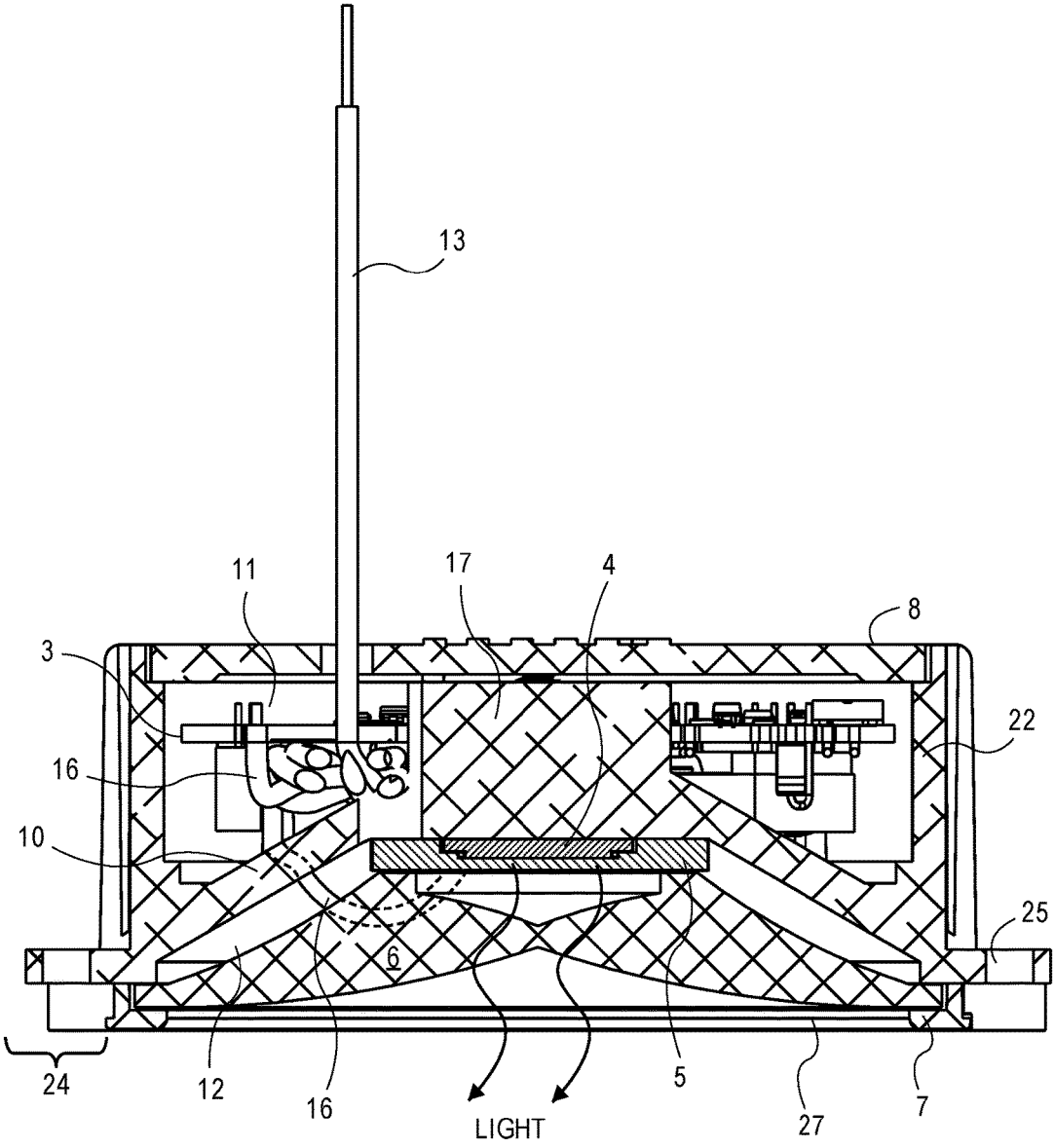
FIG. 2 shows a side cross-section view of the embodiment if FIG. 1.

As also seen in the cross-section view of the module in FIG. 2, the interior cavity of the housing 2 is divided, in a longitudinal direction (up/down), into two chambers or portions, namely a rear or top cavity 11 that is directly above a front or bottom cavity 12, by a partition 10 that extends in a lateral direction (left/right) joining a left portion of the sidewall 22 to a right portion thereof. The top cavity 11 extends to the open rear end, while the bottom cavity extends to the open front end of the housing 2. Inside the top cavity 11 there is a power supply circuit board 3 that has an input, which is connected to a number of electrical wires 13 (e.g., at least a pair) which emerge from the housing 2 and serve to deliver mains electricity power. The wires 13 serve to deliver mains electricity power, for example 120V/240 VAC power, to the power supply input of the power supply circuit board 3. The power supply circuit board 3 also has a power supply output. A number of electrical wires 16 (e.g., at least a pair) are connected at one end to the power supply output, and at another other end to the light source 4, and in between those ends the wires 16 are routed through an opening (not shown) in the partition 10.

In one embodiment, once the power supply circuit board 3 is positioned inside the top cavity 11 through the open rear end of the housing 2, the cover 8 may be placed on top of the sidewall 22, to thereby completely enclose the top cavity 11 (with the power supply circuit board 3 inside.) The cover 8 may be a plate that is shaped to entirely cover the open rear end of the housing. In one embodiment the cover 8 is attached to the housing 2, by being directly fastened to the island 17 which may be viewed as an extension of the housing 2, as shown in FIG. 2. In that case, the cover 8 may be entirely solid except for one or more screw hole openings 28 (two are shown, only as an example) and a wire opening 14. The screws 9, respectively, are inserted through the openings 28 for securing the cover 8 to the top of the island 17 (although other fasteners or other mechanisms that serve to retain the cover 8 in the closed position as shown can be alternatively used, including an arrangement that only requires one screw for example.) The electrical wires 13 are routed through the opening 14, from one end of their connections at the power supply circuit board 3 inside the top cavity 11 to another end that is outside of the housing 2 and connected to a power source (e.g. building electrical power grid.) Also, in the case where the cover 8 is to be relied upon as a further heat sink element of the lighting module, a number fins 23 may be formed on the outside (or top) face of the cover 8 to enhance the heat sink function.

As shown in FIG. 2, the partition 10 serves as a physical barrier between a) the power supply circuit board 3 and b) the light source 4 and the optic 6. In the example shown, the partition 10 is not entirely flat or horizontal, but instead has a central portion from which the rest slopes downward as shown. In one embodiment, the partition 10 is entirely solid and completely isolates the top cavity 11 from the bottom cavity 12 except for an opening (not shown) through which the wires 16 pass (and which carry electrical power from an output of the power supply circuit board 3 to the light source 4.) This provides a fire barrier within the hole that is formed in the ceiling or wall (for the recessed lighting system), between the room and the building space between walls and ceilings, which is a typical requirement with recessed lighting systems that need to comply with building and safety codes/regulations. In addition, the partition 10 may reduce the risk of electrical shock when a user is reaching into the housing 2 through the open front end, because any conductors in the power supply circuit board 3 that carry for example 120/240 Vac are shielded against by the partition 10.

In one embodiment, the island 17 is provided to enhance the heat sink function of the lighting module and to secure the cover 8 to the housing 2. The island 17 is joined to, and protrudes or rises into the top cavity 11 from, the rear face of the partition 10 (as shown.) The island 17 may have a variety of shapes (e.g., circular cylinder, polygon cylinder, oval cylinder, etc.). In one embodiment (as shown in FIG. 1), the island 17 is a circular cylinder with a flat top, and that is received (height-wise or lengthwise) into and extends past a face-to-face opening 18 of the power supply circuit board 3. The face-to-face opening 18 may be a hole that has been cut through the opposing faces of the board 3, resulting in a structure that looks like a washer. The island 17 has one or more screw holes 19 in its top that are to be aligned with the openings 28 in the cover 8, to receive one or more screws 9 (or other fasteners), respectively, to fasten the cover 8 to the island 17. Other ways of fastening the cover 8 to the partition 10 may be possible.

In one embodiment, the island 17 may be formed integrally with the partition 10, e.g., as a single cast metal piece, and wherein the periphery of the partition 10 may be attached, e.g., bonded, to the inside surface of the sidewall 22. Alternatively, the partition 10 and the island 17 may both be integrally formed with the sidewall 22, as a single-piece housing 2 (e.g., as a single cast metal piece.) The island 17 may be located at the center of the housing 2 as shown, or at the common center axis of the housing 2 (which center axis is shared by the open rear end and by the open front end of the housing 2.) The island 17 may serve to enhance the heat sink function of the lighting module, by conducting the heat that has been generated by the power supply circuit board 3 and/or by the light source 4, through the partition 10 and then outward to the sidewall 22. In addition, in one embodiment, the island 17 is tall enough so that its top abuts the bottom face of the cover 8, so that the island 17 may perform heat transfer directly to the cover 8, e.g., through a thermal paste layer that joins or is directly sandwiched between the top (or top surface) of the island 17 and the inside (or bottom) face of the cover 8.

The power supply circuit board 3 has the needed light source driver circuit components installed thereon, that are designed to ensure that the appropriate voltage and current are fed to the light source 4 to enable the emission of light by one or more light emitting elements of the light source 4. The components of the driver circuit may be installed on both the top and bottom faces of the board 3 as shown. The driver circuit draws and converts power through the wires 13, and then supplies its output power through the wires 16, to the light source 4 (and thus powers the light source 4 to emit light.) The driver may be any type of electrical power supply circuit, including power supplies that deliver an alternating current (AC) or a direct current (DC) voltage to the light source 4. For example, the driver may drop the voltage of its input power to an acceptable, safe for a human touch level in its output power, for operating the light source 4 (e.g., from 120V-277Vac to 36Vdc-48Vdc). The output power may be delivered to the light source 4 through a removable connector, a permanent connector, or soldered leads, at the power supply circuit board 3 and on a carrier or substrate of the light source 4.

As shown in FIG. 1, the power supply circuit board 3 has a face-to-face opening 18 therein that may be entirely surrounded by the driver circuit components of the printed circuit board 3 (as opposed to being located at the edge or periphery of the board 13). In one embodiment, the opening 18 is shaped and sized so that when the island 17 is passed through it, the fit between the side surface of the island 17 and the inner edge of the board 13 along the opening 18 prevents the board 3 from moving laterally (left/right), inside the housing 2, to thereby prevent the outer edge of the board (along the periphery) from touching the inside surface of the sidewall 22.

In one embodiment, where the cover 8 is to be used to close off the open rear end of the housing 2, at least two electrically insulating spacers (not shown) may be mounted to the top face of the power supply circuit board 3. Another two or more electrically insulating spacers (not shown) may be mounted to the bottom face of the board 3. The cover 8 can then be installed over the open rear end and secured to housing 2, resulting in the spacers being compressed between the partition 10 at one end and the cover 8 at another end, which fixes the height position (in the up/down direction) of the board 3 within the upper cavity 11 of the housing 2, at a desired height between the partition 10 and the cover 8.

Figure 5:
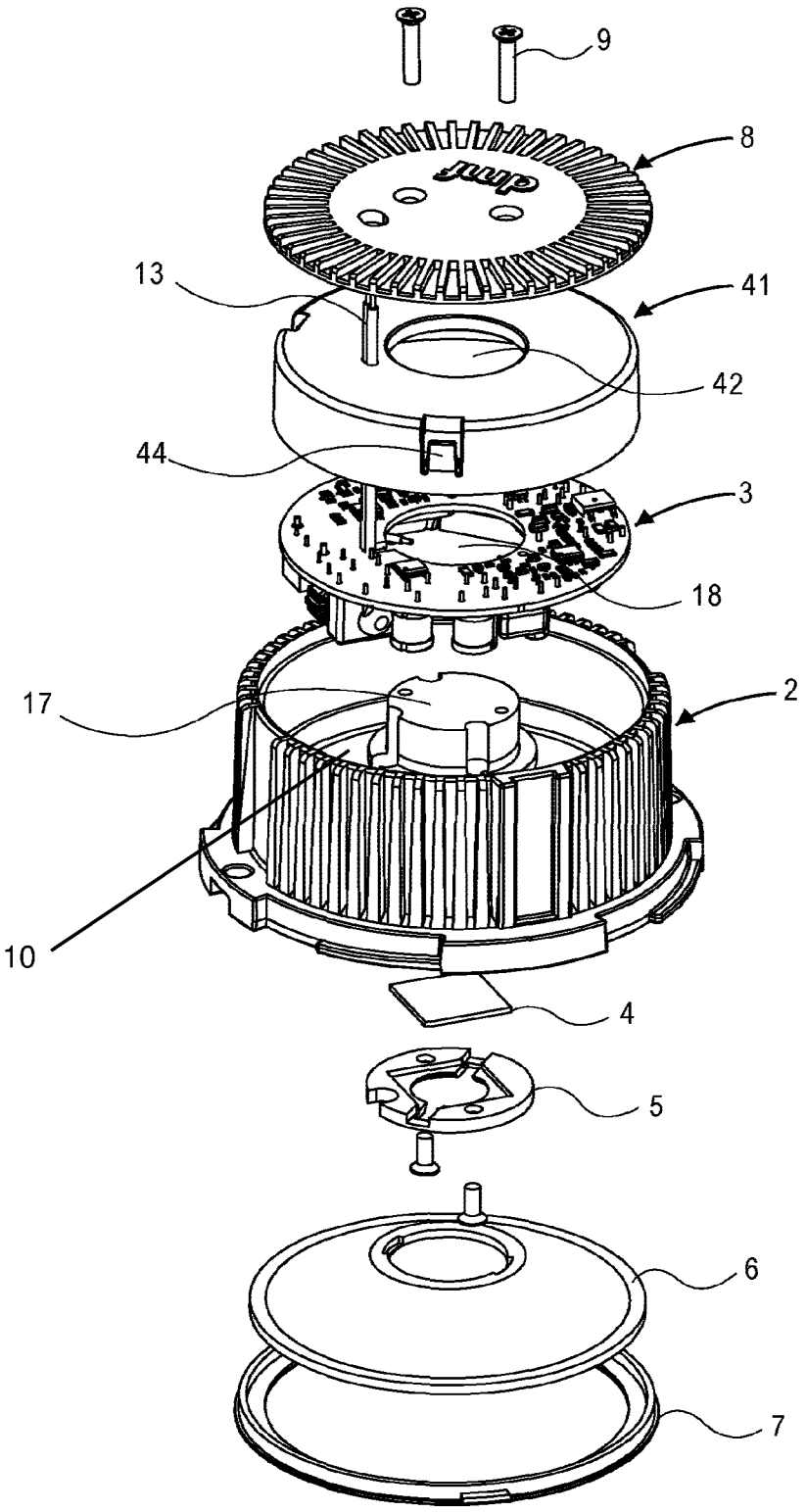
FIG. 5 is an exploded view of a lighting module in accordance with another embodiment.

Another embodiment of the lighting module is shown in the exploded view of FIG. 5 in which all of the elements shown may be similar to those in FIG. 1 and in FIG. 2, except for the addition of a cup 41. In this embodiment, there may be a gap between the side surface or sidewall of the island 17 and the inner edge of the power supply circuit board 13 that defines the opening 18 which could allow the board 3 to move around inside the housing so as to possibly touch the sidewall 22, the partition 10, or the cover 8 (if the latter is being used.) The cup 41 is provided to limit such movement of the board 3, both longitudinally (up/down) as well as laterally (left/right or sideways.) The cup 41 may be made of an electrically insulating material, such as plastic or polycarbonate, which may serve to insulate the board 3 from the housing 2 and the cover 8, especially when the latter are made of a conductive material such as a metal (e.g., as a cast, aluminum piece.) The outside height of the cup 41 may be less than the height of the sidewall 22 that is between the top surface of the partition 10 and the top of the sidewall 22, so that the cup 41 can fit entirely inside the upper cavity 11 of the housing 2 (in the orientation shown.) The inside width of the cup 41 may be the same as or slightly greater than the outer width of the board 3, so as to allow the board 3 to be inserted into the cup 41 through its mouth (in the orientation shown in FIG. 5.) At least two separate openings may be formed in the base of the cup 41, namely one through which the wires 13 are passed, and another opening 42 that is large enough for the island 17 to be inserted therein (in the height direction as shown.) For example, the opening 42 may have the same shape and be about the same size as the opening 18 in the board 3. The opening 42 is located in the base of the cup 41 so that when the board 3 is inserted into the cup 41 the opening 18 of the board 3 is aligned with the opening 42.

The wall of the cup 41 has a snap lock (or snap fit) mechanism formed therein, to retain the board 3 in position. For example, at least two flaps 44 may be formed in the wall and that are positioned in the same plane but at different radial positions about the center longitudinal axis of the cup 41. As an example, each flap 44 may be formed as a partial, generally rectangular or square cut out portion of the wall such that the flap 44 remains connected with the wall on one of its sides while its other three sides are not. The flap 44 as formed is angled inward, i.e. towards the center longitudinal axis of the cup. As the board 3 is inserted into the cup (in the orientation shown), its top face at its outer periphery pushes against and pivots the flap 44 outward until the outer periphery clears the flap 44, at which point the flap 44 "pops" back (inward) and over the bottom face of the board 3. The flap 44 then stays in that inward position, by virtue of being made of a semi-rigid material for example, thereby holding the board 3 fixed in the height direction (up/down direction) between the flap 44 and the base of the cup 41. The cup 41 with the board 3 held therein is then inserted "upside down" into the upper cavity 11, in the orientation shown, through the open rear end of the housing 2, until for example the brim of the cup 41 lands on the top face of the partition 10. In one embodiment, the flaps 44 are positioned at a height such that the tallest electronic circuit components that are mounted onto the bottom face of the board 3 do not touch the top face of the partition 10, when the cup 41 has been inserted into the housing 2 to the full extent. In one embodiment, the height of the cup 41 may be defined so that when the brim of the cup is resting against the partition 10, the outside of the base of the cup is only slightly below the top of the island 17. This allows the cover 8 to then be placed into position covering the open rear end of the housing 2, with the bottom face of the cover 8 being joined to the top of the island 17 (e.g., through a layer of thermal paste) to promote heat transfer between the island 17 and the cover 8, and then secured in that position by installing the screw 9 (through the cover 8 and into its corresponding hole 19 in the island 7.)

In yet another embodiment, the island 17 is not provided. In that case, to secure the cover 8 to the housing 2, a snap lock mechanism, a thread type, or a twist and lock mechanism may be provided on the sidewall 22 of the housing 2 (while a complementary portion is provided on the cover 8.) In that case, the cup 41 (which serves as an insulator and holder for the board 3) would not need to have the opening 42 in it. Also, the power supply circuit board 3 would not have to have the opening 18 in it. The board 3 could still be held inside the cup 41 in the manner described above (e.g., using the flaps 44), and the cup 41 could still be held by compression between the cover 8 and the partition 10. In that case, centering of the board 3 inside the upper cavity 11 would depend on centering the cup 41, by for example making the cup 41 to have just the right width to fit inside the upper cavity 11 while lightly abutting the inside surface of the sidewall 22.

Assembly of the lighting module (as shown in FIG. 1 or in FIG. 5) may continue with inserting the light source 4 into the bottom cavity 12, through the open front end of the housing 2. The light source 4 may be composed of a carrier or substrate on the bottom face of which one or more light emitting devices are installed. The light emitting devices may be any electro-optical device, or combination of different electro-optical devices, for emitting visible light to illuminate a room, whose required voltage levels are "safe" even if any of their exposed terminals come into incidental contact with a human. For example, the light emitting devices may be "low voltage" light emitting diode (LED) elements, e.g., LED devices, organic LED (OLED) devices, and polymer LED (PLED) devices. In some embodiments, the light source 4 may have multiple LED elements connected in series, yet is still deemed a low voltage LED-based light source. The light source 4 receives electricity from the board 13, as described above, such that the light source 4 may emit a controlled beam of light into a room or surrounding area. The driver circuitry (in the power supply circuit board 3) is designed to ensure that the appropriate voltage and current are fed to the light source 4. In one embodiment, light emitted by the light source 4 through the open front end of the housing, to illuminate a room, is produced only by light emitting diode (LED) elements of the light source 4 that require input power at less than 50 Volts.

The light source 4 may be attached to the partition 10 by being held or captured between a light source holder 5 and a portion of the bottom face of the partition 10, which portion may be directly underneath the island 17 as shown. An indented region may be formed on the back face of the holder 5, as best seen in FIG. 1, into which the light source 4 is fitted as shown, so as to limit the compression forces that may be imparted on the carrier of the light source 4 (as it is sandwiched between the holder 5 and the bottom face of the partition 10.) A layer of thermal paste may be applied directly to the portion of the bottom face of the partition 10 or to the top face of the carrier of the light source 4, so as to enhance heat transfer from the light source 4 to the island 17. The light source holder 5 may be affixed to the partition 10 using screws or other fasteners, a snap lock mechanism, a twist and lock mechanism, or glue. In the example shown here, screws can be inserted through the two holes 26 in the holder 5 which are aligned with the two holes 20, respectively, in the partition 10. The light source holder 5 has an opening 21 that is positioned inward of the holes 26, and through which light from the emitting devices will emerge (and then enter the room through the optic 6 that is secured to the housing 2 in front of the holder 5.) The light source holder 5 may also have an open portion (that may be shared with the opening 21) through which the proximal ends of the wires 16 can be electrically connected (e.g., soldered) to electrical terminals that are exposed on the bottom face of the carrier of the light source 4. The carrier has wire traces (not shown) that route electrical power from the terminals to the one or more light emitting devices that are installed on the bottom face of the carrier. The distal ends of the wires 16 are electrically connected to the outputs of the power supply circuit board 3. There may be an opening (not shown) in the partition 10 through which the electrical wires 16 are led, from their electrical connection at the light source 4 (in the bottom cavity 12 of the housing 2), to their electrical connection at the power supply circuit board 3 that is in the top cavity 11.

The housing 2 also has a flange or lip 24 that may extend laterally outward from the sidewall 22 and surrounds the open front end of the housing 2 as shown. The lip 24 includes features that serve to couple the housing 2 to a trim (not shown), especially via a twist and lock mechanism that does not require the use of separate tools or other devices. The trim may have features that that are complementary to the features of the lip 24 shown in FIG. 2, that form the twist and lock mechanism. The twist and lock mechanism features may include a groove or slot 29 on the lip 24 of the housing 2, which is designed to produce a friction fit against corresponding or mating structures of the trim, to create a twist-and-lock friction connection. In other embodiments, however, the trim may be coupled to the housing 2 using a resin (a permanent attachment), clips, screws, bolts, or clamps. In one embodiment, different diameter trims may be capable of being coupled to the housing 2. The size and design of the trims may depend on the size of the ceiling or wall hole behind which the recessed lighting system is to be fitted, to conceal the exposed wall or ceiling edge that defines the hole. The recessed lighting system may include two or more trims of different sizes to cover ceiling or wall openings of different sizes. The trim may need to meet the aesthetic demands of the consumer. The trim may be made of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

Still referring to the housing 2, the lip 24 of the housing 2 may also have one or more fastener openings 25 formed therein that allow the housing 2 to be attached to a junction box (e.g., an octagonal junction box) or another suitable enclosure, using screws or other suitable fasteners. The top end of the housing 2 (where the cover 8 has been attached) may be inserted into the junction box while the one or more openings 25 of the lip 24 are aligned with corresponding screw holes of the junction box, and then screws can be inserted into the openings 25 and screw holes of the junction box to fasten the housing 2 to the junction box.

As shown in FIG. 1, the recessed lighting system may include an optic 6 that is positioned in the optical path of the emitted light from the light source 4, and may adjust the way light emitted by the light source 4 is directed into or focused inside the room in which the system is installed. In one embodiment, the optic 6 may be a separate piece, i.e., separate from the housing 2 and separate from a retaining ring 7 which is used to attached the optic 6 to the housing 2 (as described further below.) The optic 6 includes a reflector portion as shown, that has a closed, curved surface which is ring-like or annular, with a central opening that is aligned with the light source 4. The rear face of the reflector portion along its inner periphery may abut the bottom (or front) face of the light source holder 5. The reflector portion may be formed of any fire retardant material, including steel, aluminum, metal alloy, calcium silicate, or other similar materials. The reflector portion may be formed to redirect the emitted light and can have any shape that serves this purpose. For example, the shortest path along the closed, curved surface of the reflector portion between its inner periphery (that defines the central opening) and its outer periphery may be a straight line or it may be a curved line (e.g., a elliptic curve, a parabolic curve, circular curve. The front surface of the reflector portion (facing the room) which lies between the inner and outer peripheries may be coated with a reflective material or include one or more reflecting elements that assist in the adjustment of light emitted by the light source 4. For example, the reflective portion may be coated with a shiny enamel or include one or more mirrors or retroreflectors or a microcellular polyethylene terephthalate (MCPET) material to adjust the path of the light emitted by the light source 4.

Figure 3:
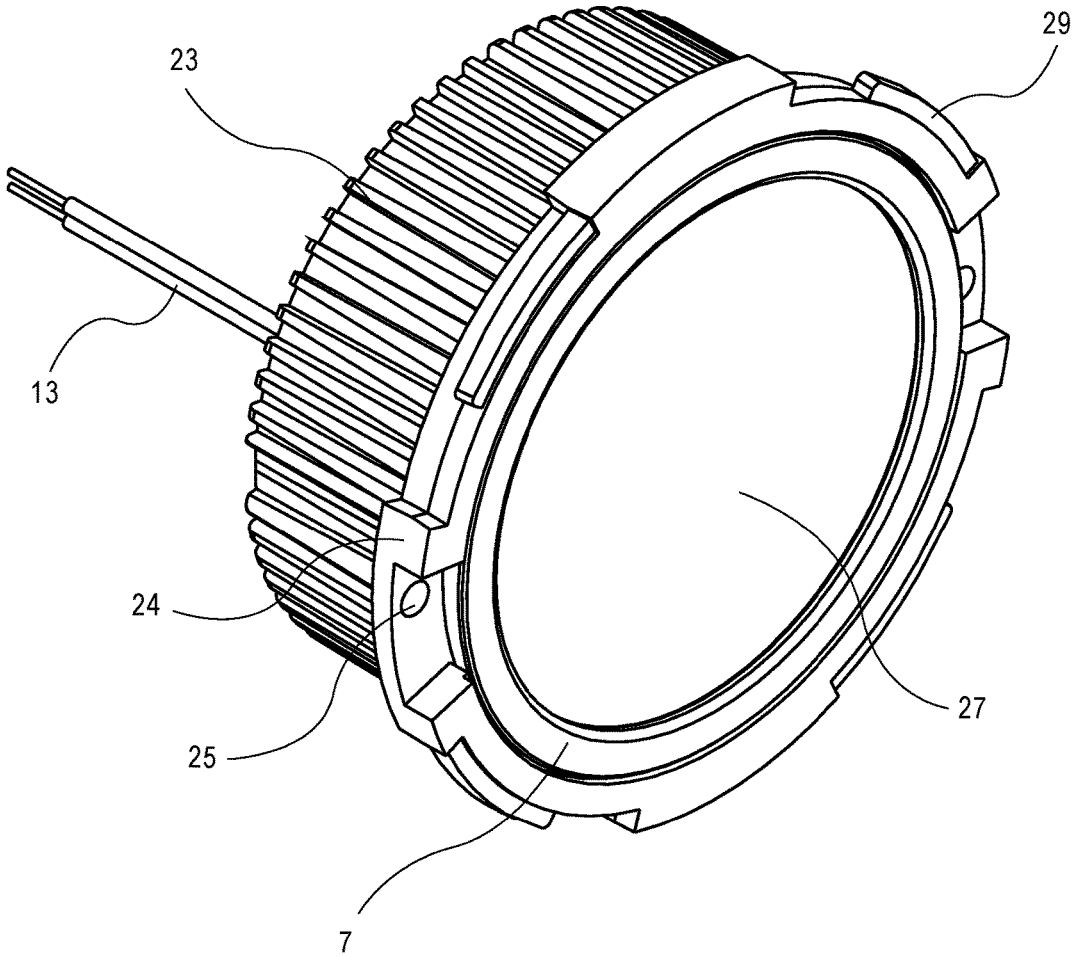
FIG. 3 shows a perspective view of the embodiment of FIG. 1.

In one embodiment, a lens/filter 27 which may be a lens only, a filter only, or a combination of the two, is attached to the outer periphery of the reflector portion—see also FIG. 3. The lens/filter 27 may serve as a protective barrier for the light source 4, and may shield the light source 4 from moisture or inclement weather. The lens/filter 27 also adjusts the emitted light that illuminates the room, via focusing and/or diffusion for example. The lens/filter 27 may be made of any at least partially transparent material, including glass and hard plastics. The reflector portion and the attached lens/filter 27 may form a single, indivisible unit of the optic 6. In one embodiment, the optic 6 may be interchangeable so that an adjustable light spread can be had in the field, by detaching the retaining ring 7 and then replacing the optic 6 with a different one. Different instances of the optic 6 may be produced, where each instance has a different combination of the lens/filter 27 and the reflector portion, so as to change the spread, angle, or other optical characteristics associated with the optic 6. The optic 6 may also have adjustable alignment features in which the orientation or position of the reflector portion or the lens/filter 27 can be changed in the field.

As shown in FIG. 1 and in FIG. 2 (and also in FIG. 5), the retaining ring 7 is attached to the housing 2, at the open front end of the housing 2, so as to hold or retain the optic 6 within the bottom cavity 12 of the housing 2. The mechanism for attaching the retaining ring 7 to the housing may be a twist and lock mechanism, with complementary features of the twist and lock mechanism being formed on a) the outside of the ring 7, such as a boss 30 as shown in FIG. 1, and b) the portion of the inside surface of the housing 2 that is next to the extended lip portion 24, as best seen in FIG. 2. In this manner, the ring 7, and thus the optic 6, may be installed into and removed from the housing 2 without requiring any tools. In one embodiment, where otherwise the optic 6 might, in one embodiment, fall out of the housing 2 due to gravity alone).

While certain embodiments of the lighting module have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A lighting module for a recessed lighting system, the lighting module comprising:

a housing having a sidewall, the sidewall surrounding an interior cavity of the housing that has an open rear end and an open front end, wherein the interior cavity is divided by a partition into a top interior cavity and a bottom interior cavity, the top interior cavity extending to the open rear end, the bottom interior cavity extending to the open front end;

a power supply circuit board positioned inside the top interior cavity of the housing;

a light source positioned inside the bottom interior cavity of the housing to emit light through the open front end of the housing that illuminates a room;

a first plurality of wires that passes through an opening in the partition, wherein the first plurality of wires is coupled to the power supply circuit board at one end and to the light source at another end, to deliver power to the light source;

a cover that covers the open rear end enclosing the top interior cavity, and is secured to the housing; and an optic position inside of the bottom cavity of the housing, the optic having a reflector portion, wherein the open rear end is sufficiently large so as to allow the power supply circuit board to be placed into and/or removed from the top interior cavity through the open rear end.

2. A lighting module for a recessed lighting system, the lighting module comprising:

a housing having a sidewall, the sidewall surrounding an interior cavity of the housing that has an open rear end and an open front end, wherein the interior cavity is divided by a partition into a top cavity and a bottom cavity, the top cavity extending to the open rear end, the bottom cavity extending to the open front end;

a power supply circuit board positioned inside the top cavity of the housing;

a light source positioned inside the bottom cavity of the housing to emit light through the open front end of the housing that illuminates a room;

a first plurality of wires that passes through an opening in the partition, wherein the first plurality of wires is coupled to the power supply circuit board at one end and to the light source at another end, to deliver power to the light source;

a cover that covers the open rear end enclosing the top cavity, and is secured to the housing; and an island extending from the partition into the top cavity of the housing, wherein the power supply circuit board has a face to face opening therein in which the island is positioned.

3. The lighting module of claim 2 wherein a top of the island abuts a bottom face of the cover and the cover is held in that condition by a fastener that is secured to the top of the island.

4. The lighting module of claim 3 further comprising a layer of thermal paste sandwiched directly between the bottom face of the cover and the top of the island.

5. The lighting module of claim 1 further comprising a cup in which the power supply circuit board is held, wherein the cup is positioned upside down within the top interior cavity of the housing so that a base of the cup is at the top of the sidewall and a brim of the cup is at the partition.

6. The lighting module of claim 1 wherein the cover has an opening formed therein through which a second plurality of wires emerges from the housing and that are connected to an input of the power supply circuit board inside the housing, wherein the second plurality of wires delivers main electricity power to the input of the power supply circuit board.

7. The lighting module of claim 1 wherein the light source comprises a carrier having i) a top face that abuts a bottom face of the partition and ii) a bottom face on which there are a plurality light emitting diode (LED) elements, wherein the bottom face of the carrier has a plurality of electrical terminals to which the first plurality of wires is coupled, wherein the carrier routes electrical power from the terminals to the LED elements.

8. The lighting module of claim 1 wherein:

the reflector portion of the optic includes i) an inner periphery that defines a central opening which is aligned with the light source and through which the emitted light passes, and ii) an outer periphery;

the optic further includes a lens/filter that is attached to the outer periphery of the reflector portion; and the lighting module further comprises a retaining ring attached to the housing at the open front end so as to hold or retain the optic within the bottom cavity.

9. The lighting module of claim 8 wherein the reflector portion and the attached lens/filter form a single, indivisible unit of the optic.

10. The lighting module of claim 1 wherein the housing further comprises a lip that extends laterally outward from the sidewall of the housing and surrounds the open front end of the housing, wherein the lip comprises a twist and lock mechanism to couple the housing to a trim.

11. The lighting module of claim 10 wherein the lip has an opening formed therein to receive a fastener for attaching the lighting module to a junction box or to another enclosure in which the lighting module has been inserted.

12. A lighting module for a recessed lighting system, the lighting module comprising:

a housing having a sidewall, the sidewall surrounding an interior cavity of the housing that has an open rear end and an open front end, wherein the interior cavity is divided by a partition into a top interior cavity and a bottom interior cavity, the top interior cavity extending to the open rear end, the bottom interior cavity extending to the open front end;

a power supply circuit board positioned inside the top interior cavity of the housing;

a light source positioned inside the bottom interior cavity of the housing, wherein light emitted by the light source through the open front end of the housing, to illuminate a room, is produced only by a plurality of light emitting diode (LED) elements of the light source that require input power at less than 50 Volts; and a first plurality of wires that passes through an opening in the partition, wherein the first plurality of wires is coupled to the power supply circuit board at one end and to the light source at another end, to deliver the input power at less than 50 Volts to the light source, wherein the open rear end is sufficiently large so as to allow the power supply circuit board to be placed into and/or removed from the top interior cavity through the open rear end.

13. The lighting module of claim 12 wherein the partition is entirely solid and completely isolates the top cavity from the bottom cavity except for said opening through which the first plurality of wires passes.

14. The lighting module of claim 12 further comprising a second plurality of wires that at one end is connected to an input of the power supply circuit board inside the housing, wherein the second plurality of wires delivers main electricity power to the input of the power supply circuit board.

15. The lighting module of claim 14 further comprising a cover that covers the open rear end and encloses the top interior cavity, and is secured to the housing by a fastener, wherein the cover has an opening formed therein through which the second plurality of wires emerges from the housing.

16. The lighting module of claim 12 wherein the light source comprises a carrier having i) a top face that abuts a bottom face of the partition and ii) a bottom face on which are installed a plurality light emitting diode (LED) elements that emit the light to illuminate the room, wherein the bottom face of the carrier has a plurality of electrical terminals to which the first plurality of wires is coupled, wherein the carrier routes electrical power from the terminals to the plurality of LED elements.

17. The lighting module of claim 12 further comprising:

an optic positioned inside of the bottom cavity of the housing, wherein the optic has a) a reflector portion having i) an inner periphery that defines a central opening which is aligned with the light source and through which the emitted light passes, and ii) an outer periphery, and b) a lens/filter that is attached to the outer periphery of the reflector portion; and a retaining ring attached to the housing at the open front end so as to hold or retain the optic within the bottom cavity, and wherein the retaining ring can be removed from the housing and reinstalled without any tool.

18. The lighting module of claim 17 wherein the reflector portion and the attached lens/filter form a single, indivisible unit of the optic.

19. A lighting module for a recessed lighting system, the lighting module comprising:

a housing having a sidewall, the sidewall surrounding an interior cavity of the housing that has an open rear end and an open front end, wherein the interior cavity is divided by a partition into a top cavity and a bottom cavity, the top cavity extending to the open rear end, the bottom cavity extending to the open front end;

a power supply circuit board positioned inside the top cavity of the housing;

a light source positioned inside the bottom cavity of the housing, wherein light emitted by the light source through the open front end of the housing, to illuminate a room, is produced only by a plurality of light emitting diode (LED) elements of the light source that require input power at less than 50 Volts;

a first plurality of wires that passes through an opening in the partition, wherein the first plurality of wires is coupled to the power supply circuit board at one end and to the light source at another end, to deliver the input power at less than 50 Volts to the light source; and an island extending from the partition into the top cavity of the housing, wherein the power supply circuit board has a face to face opening therein in which the island is positioned.

20. The lighting module of claim 19 further comprising a cover that covers the open rear end of the housing and encloses the top cavity, and is secured to the housing by a fastener, wherein the cover has an opening formed therein through which the second plurality of wires emerges from the housing, and wherein a top of the island abuts a bottom face of the cover and the cover is held in that condition by the fastener.

21. The lighting module of claim 19 further comprising a cup in which the power supply circuit board is held, wherein the cup is positioned upside down within the top interior cavity of the housing so that a base of the cup is at the top of the sidewall and a brim of the cup is at the partition.

22. The lighting module of claim 21 further comprising a cover that covers the open rear end of the housing and encloses the top interior cavity and is secured to the housing by a fastener, wherein the base of the cup has an opening therein through which a top of the island abuts a bottom face of the cover and the cover is held in that condition by the fastener being secured to the top of the island.

23. The lighting module of claim 1, wherein the partition and the sidewall are integrally formed as a single cast metal piece.

24. The lighting module of claim 12, wherein the partition and the sidewall are integrally formed as a single cast metal piece.

* * * * *